US009919171B2

(12) United States Patent
Marino

(10) Patent No.: US 9,919,171 B2
(45) **Date of Patent: *Mar. 20, 2018**

(54) FLUID CONTROL DEVICE AND METHOD FOR PROJECTING A FLUID

(71) Applicant: WaterShield LLC, Englewood, CO (US)

(72) Inventor: Robert M. Marino, Springdale, AR (US)

(73) Assignee: Watershield LLC, Englewood, CO (US)

( * ) Notice: Subject to any disclaimer, the term of this patent is extended or adjusted under 35 U.S.C. 154(b) by 276 days.

This patent is subject to a terminal disclaimer.

(21) Appl. No.: 14/685,070

(22) Filed: Apr. 13, 2015

(65) Prior Publication Data

US 2015/0246250 A1 Sep. 3, 2015

Related U.S. Application Data

(63) Continuation-in-part of application No. 12/172,566, filed on Jul. 14, 2008, now Pat. No. 9,004,376.

(60) Provisional application No. 60/949,432, filed on Jul. 12, 2007.

(51) Int. Cl.

| | |
|---|---|
| ***B05B 1/30*** | (2006.01) |
| ***A62C 31/03*** | (2006.01) |
| ***B05B 1/12*** | (2006.01) |
| ***B05B 1/34*** | (2006.01) |
| *B05B 15/02* | (2006.01) |
| *A62C 31/12* | (2006.01) |

(52) U.S. Cl.

CPC ..... *A62C 31/03* (2013.01); *B05B 1/12* (2013.01); *B05B 1/3033* (2013.01); *B05B 1/34* (2013.01); *A62C 31/12* (2013.01); *B05B 15/0241* (2013.01)

(58) Field of Classification Search

CPC ..... A62C 131/02; A62C 31/12; B05B 1/3033; B05B 1/12; B05B 15/0241

USPC ..... 239/581.1, 581.2, 513, 514, 579

See application file for complete search history.

(56) References Cited

U.S. PATENT DOCUMENTS

| | | | |
|---|---|---|---|
| 22,819 | A | 2/1859 | Parrott |
| 186,310 | A | 4/1877 | Curtis |
| 351,968 | A | 11/1886 | Derrick |
| 583,135 | A | 5/1897 | Wilson |
| 584,197 | A | 6/1897 | Snider |
| 603,144 | A | 4/1898 | Kellerman et al. |

(Continued)

FOREIGN PATENT DOCUMENTS

| | | |
|---|---|---|
| JP | 63176563 | 11/1988 |
| JP | 2002102378 | 4/2002 |
| JP | 2002369892 | 12/2002 |

OTHER PUBLICATIONS

"Sabert Jet Nozzles"; Akron Brass Company (Internet Advertisement); 2001; 3 pgs.; http://www.akronbrass.com/products/saberjet.htm.

(Continued)

*Primary Examiner* — Arthur O Hall
*Assistant Examiner* — Tuongminh Pham
(74) *Attorney, Agent, or Firm* — Sheridan Ross P.C.

(57) ABSTRACT

A nozzle for use in dispensing a fluid, such as water or a foaming agent to extinguish a fire, comprises a longitudinal body that comprises a plurality of helical shaped cam paths. The cam paths allow the operator of the nozzle to adjust a flow setting for the nozzle by moving a flow adjustment mechanism that is operatively associated with the cam paths.

27 Claims, 13 Drawing Sheets

(56) References Cited

U.S. PATENT DOCUMENTS

| | | | |
|---|---|---|---|
| 690,754 | A | 1/1902 | McKechney |
| 692,571 | A | 2/1902 | Wieman |
| 721,665 | A | 3/1903 | Busha |
| 851,603 | A | 4/1907 | Long |
| 930,095 | A | 8/1909 | Seagrave |
| 1,004,770 | A | 10/1911 | Galloway |
| 1,040,899 | A | 10/1912 | Dahmen |
| 1,072,951 | A | 9/1913 | Johnston |
| 1,132,935 | A | 3/1915 | Hopkins |
| 1,823,277 | A | 9/1931 | Lum |
| 1,865,012 | A | 6/1932 | Jackson |
| 1,893,298 | A | 1/1933 | Moore |
| 2,176,699 | A | 10/1939 | Anderson |
| 2,218,411 | A | 10/1940 | Albach et al. |
| 2,271,800 | A | 2/1942 | Meussdorffer |
| 2,303,992 | A | 12/1942 | Frazer et al. |
| 2,307,014 | A | 1/1943 | Becker et al. |
| 2,331,741 | A | 10/1943 | Smith |
| 2,389,642 | A | 11/1945 | Schellin et al. |
| 2,567,176 | A | 9/1951 | Ballard |
| 2,569,996 | A | 10/1951 | Kollsman |
| 2,585,509 | A | 2/1952 | Smith |
| 2,806,741 | A | 9/1957 | Fishelson et al. |
| 2,936,960 | A | 5/1960 | Thompson |
| 2,959,359 | A | 11/1960 | Casaletto |
| 2,988,289 | A | 6/1961 | Thompson |
| 2,991,016 | A | 7/1961 | Allenbaugh, Jr. |
| 3,018,792 | A | 1/1962 | Brucker |
| 3,163,363 | A | 12/1964 | Travis |
| 3,204,664 | A | 9/1965 | Gorchev et al. |
| 3,301,492 | A | 1/1967 | Kinqslev |
| 3,363,842 | A | 1/1968 | Burns |
| 3,494,561 | A | 2/1970 | Buehler |
| 3,539,112 | A | 11/1970 | Thompson |
| 3,684,192 | A | 8/1972 | McMillan |
| 3,776,470 | A | 12/1973 | Tsuchiya |
| 3,837,362 | A | 9/1974 | Barnes |
| 3,863,844 | A | 2/1975 | McMillan |
| 3,923,247 | A | 12/1975 | White |
| RE29,717 | E | 8/1978 | Thompson |
| 4,172,559 | A | 10/1979 | Allenbaugh, Jr. |
| 4,252,278 | A | 2/1981 | McMillan |
| 4,289,277 | A | 9/1981 | Allenbaugh |
| 4,342,426 | A | 8/1982 | Gagliardo |
| 4,358,058 | A | 11/1982 | Bierman |
| 4,383,550 | A | 5/1983 | Sotokazu |
| 4,436,111 | A | 3/1984 | Gold et al. |
| 4,589,439 | A | 5/1986 | Steingass |
| 4,653,693 | A | 3/1987 | Steingass |
| 4,770,212 | A | 9/1988 | Wienck |
| 4,776,517 | A | 10/1988 | Heren |
| 4,785,998 | A | 11/1988 | Takaai |
| 4,859,157 | A | 8/1989 | Adler |
| 4,941,614 | A | 7/1990 | Ilott |
| 4,944,460 | A | 7/1990 | Steingass et al. |
| 4,982,897 | A | 1/1991 | Matusita et al. |
| 5,215,254 | A | 6/1993 | Haruch |
| 5,261,494 | A | 11/1993 | McLouchlin et al. |
| 5,312,048 | A | 5/1994 | Steinaass et al. |
| 5,390,696 | A | 2/1995 | Bird et al. |
| 5,590,719 | A | 1/1997 | McLoughlin et al. |
| 5,593,092 | A | 1/1997 | McMillan et al. |
| 5,775,596 | A | 7/1998 | Whisman et al. |
| 5,848,752 | A | 12/1998 | Kolacz et al. |
| D414,243 | S | 9/1999 | Steingass et al. |
| 5,964,410 | A | 10/1999 | Brown et al. |
| 6,007,001 | A | 12/1999 | Hilton |
| 6,039,269 | A | 3/2000 | Mandzukic |
| 6,089,474 | A | 7/2000 | Marino |
| 6,102,308 | A | 8/2000 | Steingass et al. |
| 6,109,360 | A | 8/2000 | Mandzukic et al. |
| 6,113,004 | A | 9/2000 | Steinaass et al. |
| 6,173,940 | B1 | 1/2001 | Kardohely et al. |
| 6,305,621 | B1 | 10/2001 | Kolacz et al. |
| 6,354,320 | B1 | 3/2002 | Kolacz et al. |
| 6,474,569 | B1 | 11/2002 | Brundish et al. |
| 6,598,810 | B2 | 7/2003 | Lanteri |
| 7,195,181 | B2 | 3/2007 | Steingass et al. |
| 7,258,285 | B1 | 8/2007 | Combs et al. |
| 7,320,333 | B2 | 1/2008 | Trapp et al. |
| 7,322,372 | B2 | 1/2008 | Trapp |
| 7,823,801 | B2 | 11/2010 | McGarry et al. |
| 9,004,376 | B2 | 4/2015 | Marino |
| 2003/0127541 | A1 | 7/2003 | Marino |
| 2005/0017095 | A1 | 1/2005 | Mehr |
| 2005/0258275 | A1 | 11/2005 | Williams |
| 2007/0290063 | A1 | 12/2007 | Combs et al. |
| 2008/0060706 | A1 | 3/2008 | Combs |
| 2009/0236446 | A1 | 9/2009 | Trapp et al. |

OTHER PUBLICATIONS

"What Goes Around . . . Comes Around . . . ", Task Force Tips; Sep. 4, 2001; 2 pgs. (Advertisement).

Official Action for U.S. Appl. No. 12/172,566, dated Sep. 1, 2010.

Official Action for U.S. Appl. No. 12/172,566, dated Jan. 12, 2011.

Official Action for U.S. Appl. No. 12/172,566, dated Oct. 18, 2011.

Official Action for U.S. Appl. No. 12/172,566, dated Apr. 25, 2014 10 pages.

Notice of Allowance for U.S. Appl. No. 12/172,566, dated Dec. 10, 2014 12 pages.

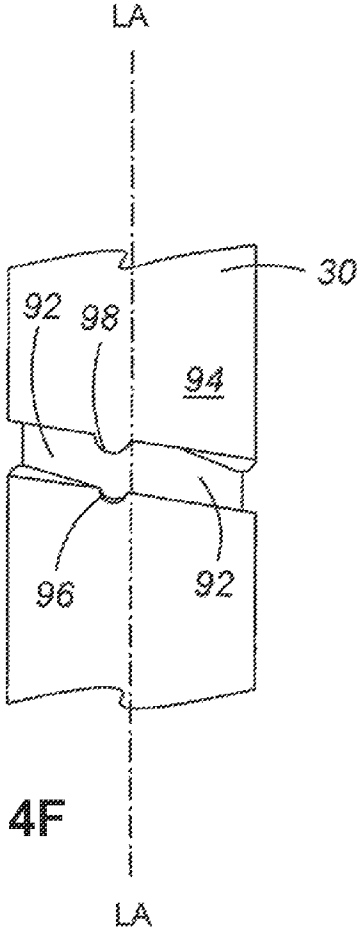
FIG. 4F
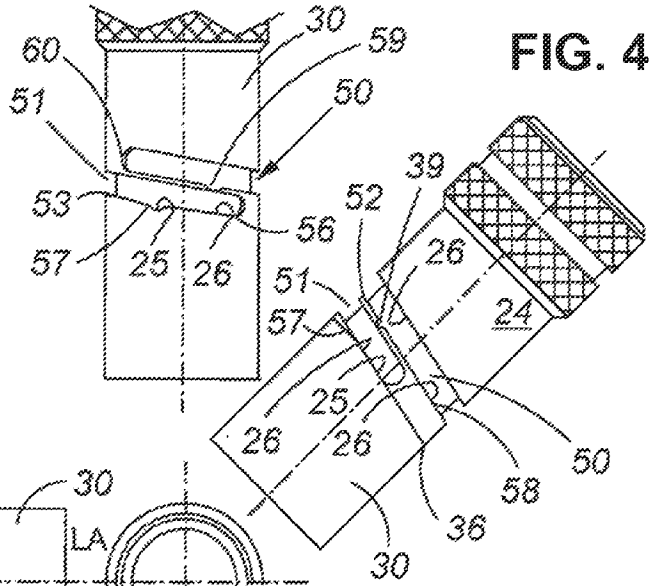
FIG. 4D
FIG. 4C
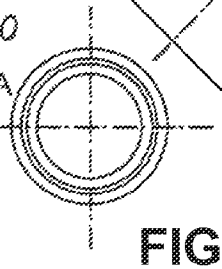
FIG. 4E
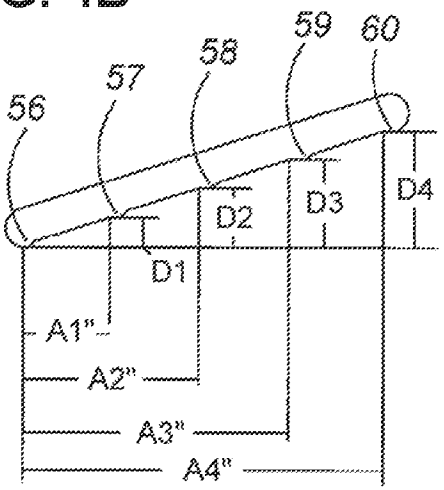
FIG. 4B
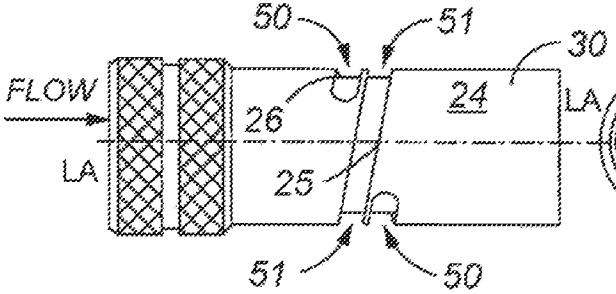
FIG. 4A

FLUID CONTROL DEVICE AND METHOD FOR PROJECTING A FLUID

CROSS-REFERENCE TO RELATED APPLICATIONS

This application is a continuation-in-part of U.S. patent application Ser. No. 12/172,566, filed Jul. 14, 2008 and issued Apr. 14, 2015, as U.S. Pat. No. 9,004,376, which claims the benefit of U.S. Provisional Application No. 60/949,432, filed Jul. 12, 2007. U.S. patent application Ser. No. 12/172,566 is incorporated fully herein by reference.

FIELD OF THE INVENTION

The present invention relates to a nozzle and method of using the same, and more particularly, to a nozzle that has a selectably adjustable flow and maintains the coherence and reach of the flow stream over a range of flow variability.

BACKGROUND

Fire hose nozzles are used by fire fighters for supplying water or other liquids to extinguish fires. A common method of extinguishing fires is to direct a flow of liquid, usually water, onto the fire and often the surrounding area. The flow rate may have to be reduced or increased, depending on the changing character of the fire. Thus, nozzles are needed that provide a variety of flow rates.

In addition, the shape or flow pattern of the flow of liquid produced by the nozzle may impact its effectiveness in fighting a fire. A flow of fluid that includes a consistent velocity throughout the fluid stream produces a solid column of liquid, which is preferable to a column of water that includes varying degrees of velocity throughout the flow of liquid. Water streams having a consistent velocity travel further and are more accurate than water streams having an inconsistent velocity. Prior art fire hose nozzles suffer from the inability to produce a variable stream of liquid that which has a consistent velocity throughout the flow of fluid. For nozzles which are able to adjust the rate at which fluid flows through the nozzle, the inner diameter of the nozzle is typically deformed in a manner that produced grooves, bumps or other irregularities. These irregularities lead to inconsistent velocities within the flow of fluid. In addition, prior art nozzles do not overcome the "wall effect," which results in a slower velocity for those portions of the fluid that are proximate to an interior wall of the nozzle. Accordingly, it would be desirable to have a nozzle which provides a smooth column of water at variable flow rates.

SUMMARY

It is to be understood that the present invention includes a variety of different versions or embodiments, and this Summary is not meant to be limiting or all-inclusive. This Summary provides some general descriptions of some of the embodiments, but may also include some more specific descriptions of certain embodiments.

A nozzle in accordance with at least one embodiment of the present invention has an end bell that may be twisted, the flow delivered from the nozzle being substantially proportional to the twisting of the end bell. In at least one embodiment, one or more cam followers traverse along a helical shaped cam path, allowing an operatively associated slider to longitudinally move within a flow chamber of the nozzle to influence a flow rate through the nozzle. In addition, in at least one embodiment of the present invention, the range of twisting of the end bell varies between approximately one-half and one full revolution. In at least one embodiment, the flow delivered from the nozzle has a range of approximately 90 feet in a 100 GPM configuration and 130 feet in a 200 GPM configuration. At least one nozzle in accordance with the present invention delivers a substantially solid stream of fluid for any rate of flow within the usable flow range.

A nozzle in accordance with at least one embodiment of the present invention includes an annulus ring or "spider", which provides a mounting for a tapered entrance and an exit pin. The tapered entrance pin and the tapered exit pin accelerate and guide the flow of fluid prior to the fluid exiting the nozzle. In addition to providing a mounting for the entrance and exit pin, the spider provides a means for shaping, adjusting and/or straightening a flow of fluid which passes through the spider. In one embodiment, the spider includes one or more ends, which define fluid passageways approximate to one or more fins. The dimensions of the fluid passageway(s) may be optimized to provide the ability to flush debris therethrough.

Embodiments of the present invention may comprise any one or more of the novel features described herein, including in the Detailed Description, and/or shown in the drawings. As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably, but that "consisting essentially of" denotes particular features only and thus is partially closed-ended.

Various embodiments of the present invention are set forth in the attached figures and in the detailed description of the invention as provided herein and as embodied by the claims. It should be understood, however, that this Summary may not contain all of the aspects and embodiments of the present invention, is not meant to be limiting or restrictive in any manner, and that the invention as disclosed herein is and will be understood by those of ordinary skill in the art to encompass obvious improvements and modifications thereto.

Additional advantages of the present invention will become readily apparent from the following discussion, particularly when taken together with the accompanying drawings.

Nothing herein should be construed as an admission of knowledge in the prior art of any portion of the present invention. Furthermore, citation or identification of any document in this application is not an admission that such document is available as prior art to the present invention, or that any reference forms a part of the common general knowledge in the art.

BRIEF DESCRIPTION OF THE DRAWINGS

A better understanding of the invention may be had by reference to the following description, taken in conjunction with the accompanying drawings, in which:

FIGS. 4A-4D are different views of a cam used to control nozzle flow settings of a nozzle in accordance with an embodiment of the present invention;

FIG. 4E is an end elevation view of the device shown in FIG. 4A;

FIG. 4F is a perspective view of a portion of a longitudinal body in accordance with an embodiment of the present invention, the longitudinal body including a cam track;

The drawings are not necessarily to scale, and may, in part, include exaggerated dimensions for clarity.

DETAILED DESCRIPTION

Embodiments of the present invention include a novel nozzle for use in dispensing a liquid. More particularly, and by way of example and not limitation, embodiments of the present invention have application for use as a nozzle to project a liquid from a hose or a water cannon for fire fighting, wherein the liquid comprises water or a liquid fire fighting agent, such as a fire suppression chemical or a foaming agent. The nozzle may also have application for dispensing other liquids or materials, such as dispensing liquids that are not used in fighting fires, for example, such as in cleaning, rinsing, temperature control operations, and solids (e.g., aggregate) separation. Although presented herein in connection with fire fighting equipment, the present invention may be used wherever nozzles are used to apply a fluid and/or gas. Nozzle embodiments presented herein are also applicable to lawn and garden nozzles, sprinkling equipment, snow making equipment, power washing equipment, fuel injectors, perfume sprayers and other types of spray applicators. Accordingly, such other applications are encompassed by the scope of the present invention. In at least one embodiment of the invention, a rotatable flow adjuster allows the user of the nozzle to grip the adjuster and twist the adjuster for proportionally modifying the rate of flow of a liquid from the nozzle, wherein the nozzle delivers a solid stream of fluid for any flow within the nozzle's flow range.

Figure 1:
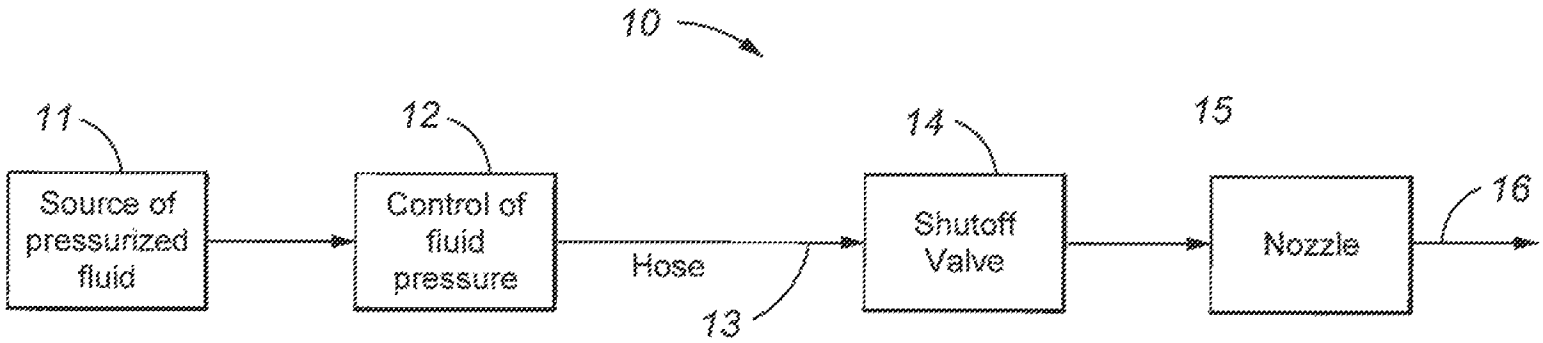
FIG. 1 is a block diagram depicting a system that includes a nozzle in accordance with an embodiment of the present invention.

Referring now to FIG. 1, an exemplification of a system 10 including a nozzle 15 in accordance with an embodiment of the present invention is shown. The system 10 comprises a source of pressurized fluid 11 (e.g., water, chemical, foaming agent, etc.), a means for controlling 12 the pressure of the fluid, such as one or more throttling valves, a hose 13 that conducts the fluid to a shutoff valve 14, and nozzle 15. The nozzle 15 converts the static energy in the pressurized fluid into dynamic energy in the form of an exit stream 16. In accordance with certain embodiments of the present invention, the system 10 may not include a hose 13. The nozzle 15 may be connected to the source of pressurized fluid 11 by a rigid tube or pipe. Alternatively, the nozzle 15 may be connected directly to the source of pressurized fluid 11.

Figure 2A:
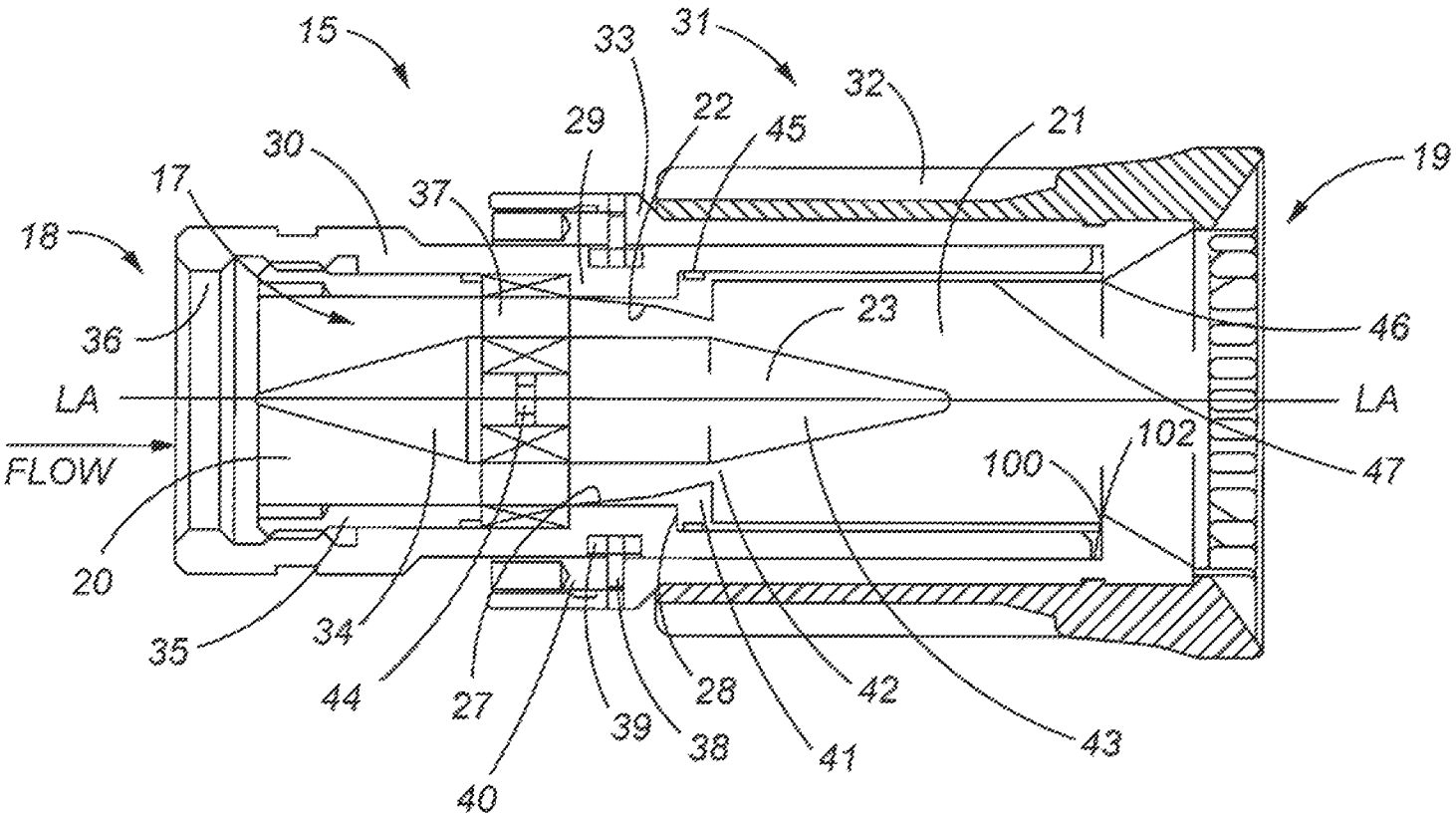
FIG. 2A is a cross-sectional view of a nozzle in accordance with an embodiment of the present invention, the nozzle configured in its low flow setting.
Figure 2B:
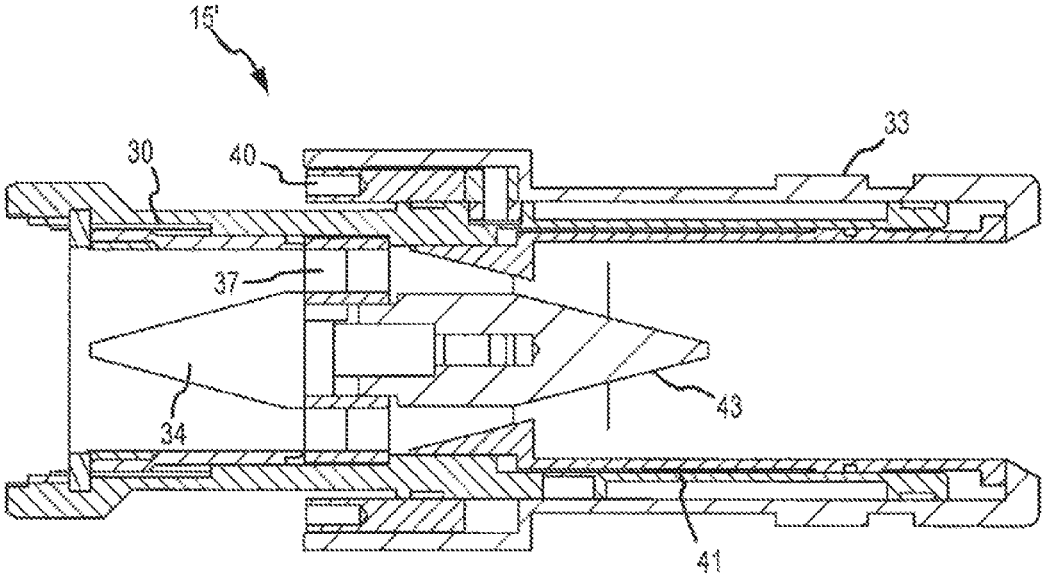
FIG. 2B is a cross-sectional view of a nozzle in accordance with an alternative embodiment of the present invention, the nozzle configured in its low flow setting.
Figure 2C:
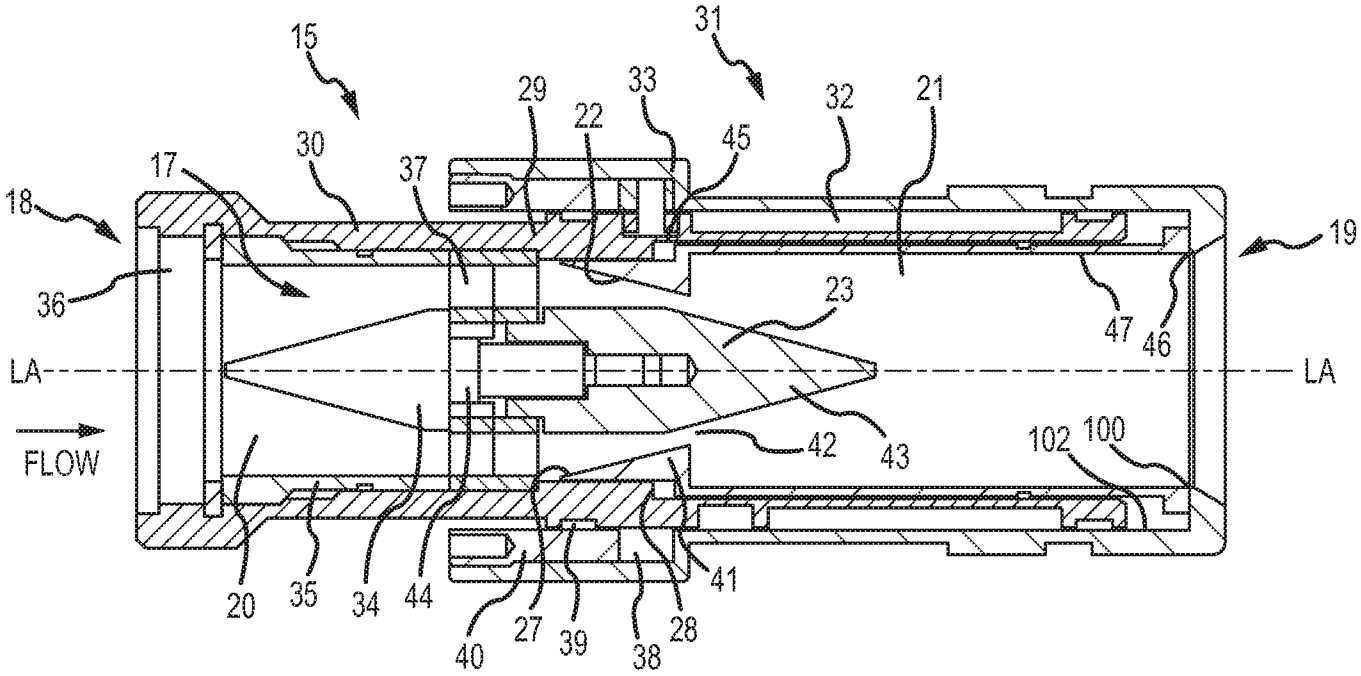
FIG. 2C is a cross-sectional view of a nozzle in accordance with an embodiment of the present invention, the nozzle configured in its low flow setting.

Referring now to FIGS. 2A and 2C, an example of an embodiment of the nozzle 15 is shown in cross-sectional view. As shown in FIGS. 2A and 2C, the nozzle 15 comprises a longitudinal body 30 provided in association with a rotatable flow adjuster 31. The longitudinal body 30 is oriented along longitudinal axis LA-LA. A flow chamber 17 within the longitudinal body 30 extends between entrance end 18 and exit end 19. The longitudinal body 30 includes a connection portion 36 for facilitating attachment of the nozzle 15 to either a hose 13 (not shown) or shutoff valve 14 (see FIGS. 8A and 8B). The connection portion 36 may a suitable mechanism such as a bayonet mount, threads, a quick-connect type of fitting, a tongue and groove connector, etc, with threads being the preferred connection mechanism.

Within longitudinal body 30 are a tapered entrance pin 34, a tapered exit pin 43, and an attachment member 44 that connects pins 34 and 43 to an annulus ring or "spider" 37. As described in greater detail below, the pins 34 and 43 and the spider 37 accelerate and shape the flow of fluid prior to its exit from the nozzle 15. The "spider" 37 is so named because of its appearance when viewed from a particular orientation. The spider 37 is retained in longitudinal body 30 by a hollow nut 35. Also contained in longitudinal body 30 is a sliding member or slider 41. The slider 41 is disposed in the interior of the longitudinal body 30 and it slideably moveable along the axis of the longitudinal body 30 within constraints defined by the position of the adjuster 31. An orifice restriction 42 is formed between the tapered exit pin 43 and the slider 41. An O-ring seal 45 located between slider 41 and longitudinal body 30 prevents leakage of fluid around the outside of the slider 41.

The adjuster 31 includes an end bell 32 and a downstream housing portion 33. The downstream housing portion 33 is interconnected to a cam follower ring 40. As described in greater detail below, the cam follower ring 40 includes cam followers 39*a* and 39*b*, which move within cam tracks 50 and 51 disposed on the exterior surface of the longitudinal body 30. As the cam follower ring 40 is rotated, the movement of the cam followers 39*a* and 39*b* within the cam tracks 50 and 51 urges the cam follower ring 40 (and the downstream housing portion 33 to which the cam follower ring 40 is attached) in a lateral movement along the longitudinal body 30. The end bell 33 is carried with the downstream housing portion 33 as the downstream housing portion 33 moves laterally with respect to the longitudinal body 30.

Moreover, as the downstream housing portion 33 moves laterally with respect to the longitudinal body 30, the space in which the slider 41 moves is thereby adjusted. Although the slider 41 is retained within the flow chamber of the nozzle 15, it can move longitudinally within the flow chamber 17, with movement of the slider 41 in the proximal direction limited by shoulder 28 of the chamber wall 29 of the longitudinal body 30, and movement of the slider 41 in the distal direction limited by internal lip 46. When nozzle 15 is pressurized, fluid flowing through the orifice restriction 42 exerts an axial force on slider 41 that is caused by friction between the fluid and the walls and/or internal taper 22 of the slider 41. This force tends to cause slider 41 to move in a longitudinally distal direction, or downstream and away from spider 37 until slider 41 is blocked from further distal movement by internal lip 46 of downstream housing portion 33. More particularly, as fluid is allowed to flow through the flow chamber 17, the distal end 100 of the slider 41 is restricted from further longitudinal movement in the flow direction by the location of the internal lip 46, which is a projection into the flow chamber 17 from the internal wall 102 of the housing 33. That is, the axial force tends to want to move the slider 41 in a downstream direction until blocked by internal lip 46. The axial force exerted on slider 41 is thereby restrained by downstream housing portion 33.

Figure 3A:
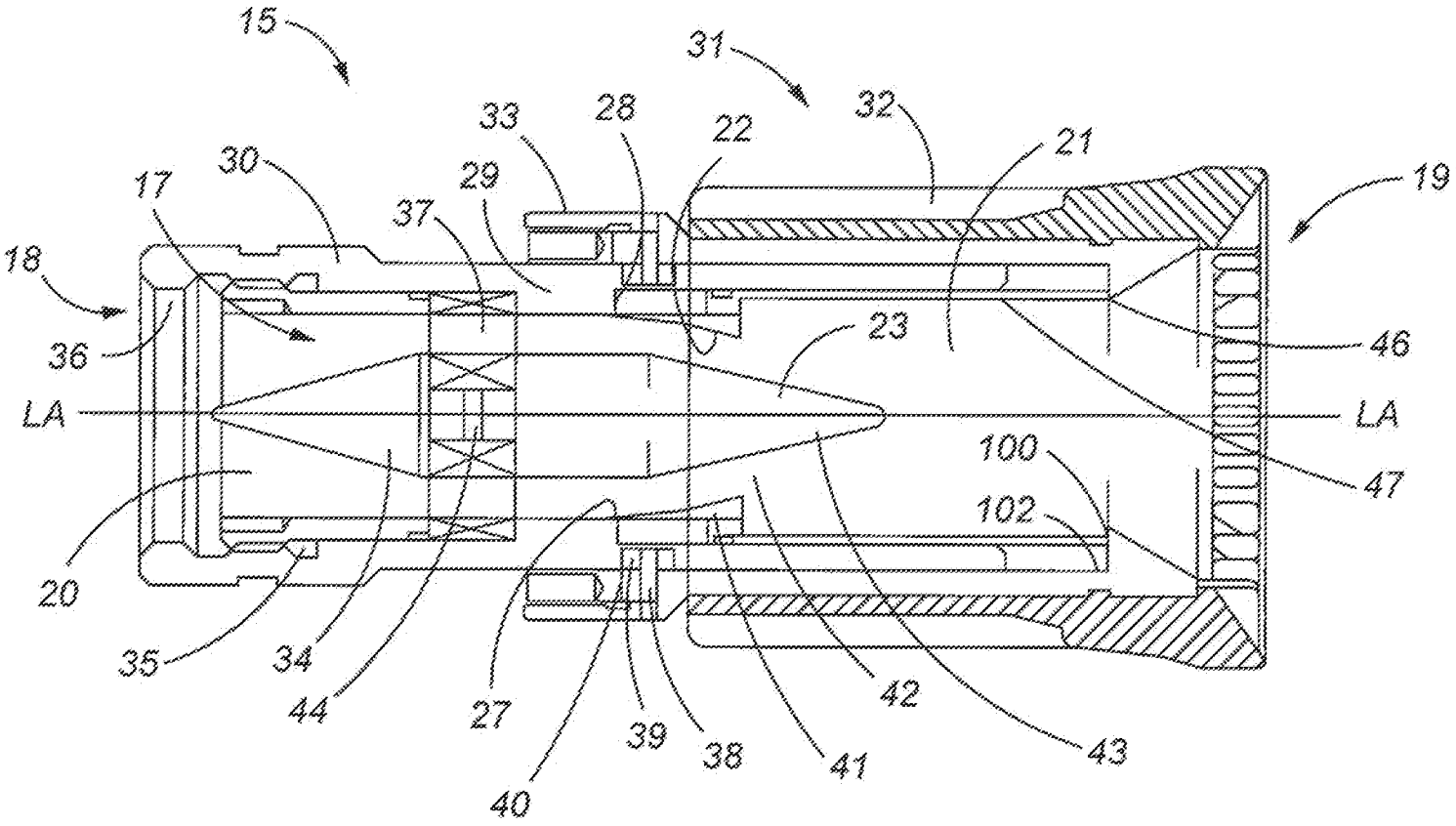
FIG. 3A is a cross-sectional view of the nozzle shown in FIG. 2A, but with the nozzle configured in its high flow setting.
Figure 3B:
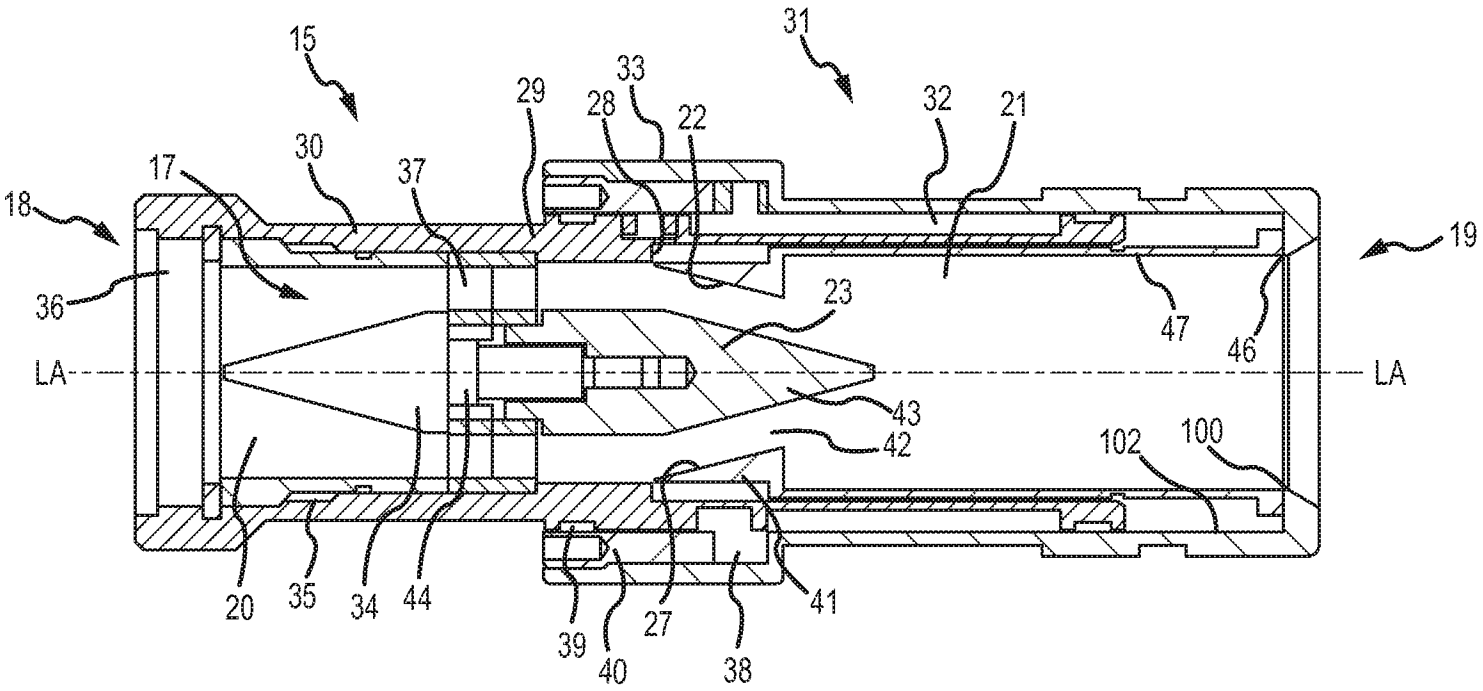
FIG. 3B is a cross-sectional view of the nozzle shown in FIG. 2C, but with the nozzle configured in its high flow setting.

FIGS. 2A and 2C illustrate the nozzle 15 adjusted to its low-flow-rate setting. In particular, the adjuster 31 has been adjusted, such as by rotation, to a position proximate to the spider 37. Accordingly, the slider 41 is retained in a position proximate to the tapered exit pin 43. In this position, the orifice restriction 42 allows a reduced amount of fluid to flow through the nozzle 15. In FIGS. 3A and 3B, nozzle 15 is shown as adjusted for its high-flow-rate setting. In particular, the adjuster 31 has been adjusted, such as by rotation, to a position distally away from the spider 37. Accordingly, the slider 41 is allowed to travel to position distally away from the tapered exit pin 43. As described above, the extent to which the slider 41 may move is limited by the internal lip 46. With the slider positioned distally away from the tapered exit pin 43, the orifice restriction 42 allows an increased amount of fluid to flow through the nozzle 15.

Figure 2D:
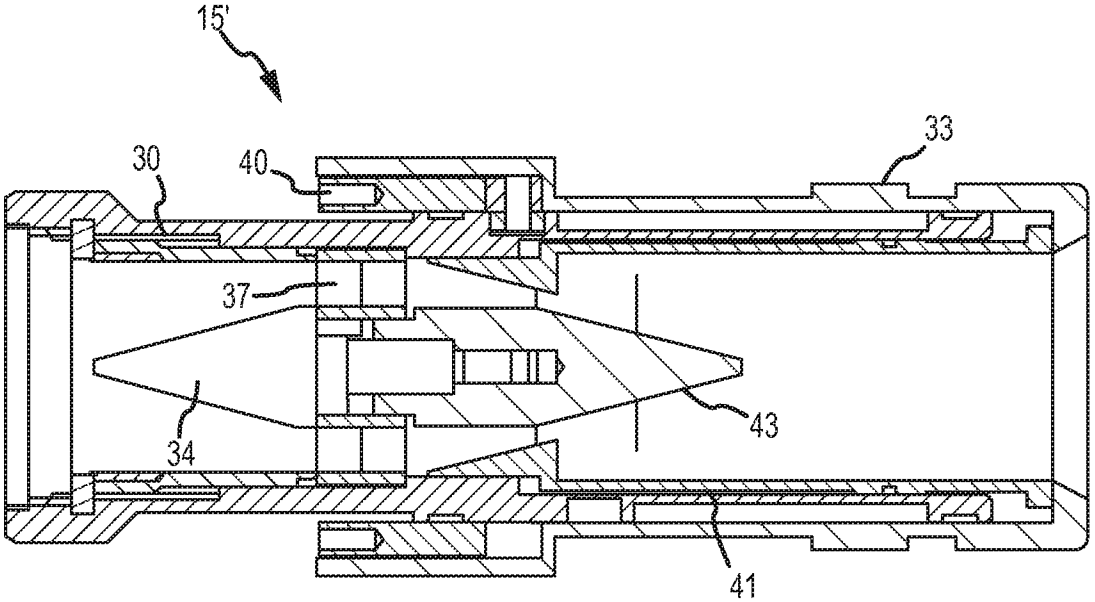
FIG. 2D is a cross-sectional view of a nozzle in accordance with an alternative embodiment of the present invention, the nozzle configured in its low flow setting.

FIGS. 2B and 2D illustrate a nozzle 15' in accordance with an alternative embodiment of the present invention. For illustrative purposes, the nozzle 15' is shown without the end bell 32. Shown in FIGS. 2B and 2D is the downstream housing portion 33 of the adjuster 31. As described above, the downstream housing portion 33 is attached to the cam follower ring 40. In FIGS. 2B and 2D, the cam follower ring 40 is rotated to a position proximate to the spider 37. Accordingly, the slider 41 is retained in a position proximate to the tapered exit pin 43. In this position, the orifice restriction 42 allows a reduced amount of fluid to flow through the nozzle 15'.

One aspect of the present invention relates to the creation of a variable space between the pin (along some portion of its extent between its entrance and exist ends) and opposing structure, such as the internal taper 22. Movement of the pin and or the internal taper with respect to one another varies the space existing for fluid to flow through the nozzle 15. Preferably, the pin is positioned in a substantially straight line along the longitudinal axis LA. It is within the scope of the present invention, however, to vary the angle of the pin within the nozzle to provide different flow effects and/or patterns. When adjusted to its high-flow setting, the orifice restriction 42 formed between slider 41 and tapered exit pin 43 is expanded, thereby allowing a greater flow of fluid from nozzle 15. Although shown at two example settings of (1) a low-flow-rate setting, as shown in FIGS. 2A and 2C, and (2) a high-flow-rate setting, as shown in FIGS. 3A and 3B, the flow rate of nozzle 15 is selectively adjustable. Thus, in accordance with at least one embodiment of the present invention, a continuum of flow settings are available between the low-flow-rate setting, as shown in FIGS. 2A and 2C, and the high-flow-rate setting, as shown in FIGS. 3A and 3B, and the operator of the valve can choose the desired flow rate by modifying the position of the adjuster 31.

The axial force on downstream housing portion 33 tends to cause adjuster 31 to also move axially away from the spider 37. Downstream housing portion 33 is attached to cam followers 39 by means of pins 38. The axial forces which the fluid flow exerts on downstream housing portion 33 are thereby transferred to cam follower 39, and finally, to the cam tracks 50 and 51 in longitudinal body 30.

Whether in the low flow position shown in FIGS. 2A and 2C or the high flow position shown in FIGS. 3A and 3B, the fluid enters nozzle 15 at entrance end 18 from either a hose 13 or shutoff valve 14, and moves into entrance region 20 and passes through the passage formed between nut 35 and entrance pin 34. The angle of the taper on tapered entrance pin 34 is preferably shallow so as to gradually accelerate the fluid with minimum loss in energy and with minimum introduction of turbulence. The fluid then flows through one or more openings or passageways 61 (see FIG. 7A) in spider 37 and is accelerated to maximum velocity as it approaches orifice restriction 42. Slider 41 includes an internal taper 22 to accelerate the fluid as it approaches orifice restriction 42 so as to minimize energy loss and to minimize the introduction of turbulence into the flow. The fluid continues to flow down tapered exit pin 43 to form a solid bore stream in exit region 21. The tapered exit pin 43 preferably includes a taper of a relatively low angle to allow the ring of flowing fluid to rejoin into a solid stream at exit region 21. The angles of the internal taper 22 on slider 41 and external taper 23 on tapered exit pin 43 are preferably complementary to encourage the fluid to follow along the external taper 23 on tapered exit pin 43 and rejoin as a solid stream of fluid exiting nozzle 15. The entrance and exit pin may in some embodiments be fashioned in one integral piece, with respective tapered regions either the same or different than one another. For example, the taper of the entrance pin may be substantially greater than the taper on the exit pin. In a preferred embodiment, the taper ranges from 45 degrees to about 1 degree, more preferably between about 35 degrees and 5 degrees, and most preferably between about 20 degrees and 10 degrees. Although diameter sizes of the nozzle may vary, in preferred embodiments, the diameter of the end bell 32 is typically such that an average human hand can comfortably manipulate the bell rotation. In a preferred embodiment, such diameter is between 5 in and 3 in.

In accordance with at least one embodiment of the invention, the internal diameter of slider 41 preferably increases significantly downstream of the orifice restriction 42, wherein the enlarged diameter of expanded bore portion 47 provides space for air to freely circulate around the outside of the fluid stream, thereby preventing the formation of a vacuum which would detrimentally influence or destroy the coherence of exit stream 16. Moreover, the pin themselves may be constructed from a variety of suitable materials (e.g. metal, plastic, composite material, etc.) and may be either solid or may be of a hollow center construction (e.g. to reduce weight characteristics of the nozzle 15).

The nozzle 15 of the present invention can be manufactured using various suitable materials, including metal, particularly brass, plastic and/or composite materials, or any combination thereof. In one particularly preferred embodiment, the nozzle 15 is made of stainless steel. In some embodiments, it may be desirable to have non-magnetic material employed. In others, the use of material that will not create a spark if dropped may be desired. In still other embodiments, the out surface of the nozzle 15 is at least partially coated or covered with an elastic or rubber-like material to prevent undesired sparks if dropped and to otherwise protect the nozzle form unintended damage.

Referring now to FIGS. 4A-4E, a number of detail views of the cam and the longitudinal body 30 are shown. In accordance with at least one embodiment of the present invention, the cam is located on a surface of a longitudinally oriented element of the nozzle 15. More particularly, the cam is situated on an outer surface 24 of longitudinal body 30. Furthermore, in at least one embodiment of the invention, there are two cams 50 and 51 having respective cam surfaces 52 and 53, wherein the two cams 50 and 51 are located along opposite sides of longitudinal body 30. In at least one embodiment of the present invention, each of cams 50 and 51 contain a series of cam detents 56, 57, 58, 59, and 60 on the cam surface 52 and 53. The cam detents 56, 57, 58, 59, and 60 are indentations that may have a circular or a semi-circular shape, which facilitates engagement with the similarly shaped cam followers 39*a* and 39*b*. The radius of each cam detent 56, 57, 58, 59, and 60 is approximately the same as the radius of cam follower 39*a* and 39*b*. The five cam detents define five different flow settings for the nozzle. The depth of the detent, the size of the radius of the detent, and the axial fluid force on slider 41 determine the relative force required to turn adjuster 31 and change the flow setting of nozzle 15. The leading edge 27 of the internal taper 22 of slider 41 presents a small profile to the flow so as to reduce the axial loading on the slider 41, and hence, on the cam detent.

In the cam example of FIGS. 4A-4D, the highest flow setting is defined by detent 56, and the lowest flow setting is defined by detent detail 60. The adjuster 31 must be turned through an angle of A4 degrees to change the nozzle from its lowest flow setting associated with detent 60 to its highest flow setting associated with detent position 56. The axial change in position for the cam is defined as distance D4. In at least one embodiment of the invention, the angle A4 is equal to about 270 degrees and the axial distance D4 is about 0.66 inches. In addition, in at least one embodiment of the present invention, the detent position 57, 58 and 59 are equally spaced angularly and axially between detent positions 56 and 60.

As those skilled in the art will appreciate, a lesser or greater number of cam detents can be used, and the angles and axial distances associated with the cam detents may also be different. By way of example and not limitation, one to fifty detents may be located along the cam surfaces preferably between one and ten, and most preferably about five, and the cam surfaces may extend through lesser or greater angles of rotation and axial distance than the example values noted above. Furthermore, the detents shown in FIGS. 4C and 4D are illustrated as arcuate-shaped indentations 25 along the lateral walls 26 of the cams 50 and 51. However, a variety or combination of shapes may be used. For example, a V-shaped or grooved indentation for a detent may be used instead of the arcuate-shaped indentations. In addition, the detents may be closer or substantially adjacent each other, thus providing a larger number of stepped flow-rate settings. Accordingly, it is to be understood that the examples provided herein are for purposes of enablement, and are not intended to be limiting.

Referring now to FIG. 4F, and in accordance with at least one embodiment of the present invention, a portion of a longitudinal body 30' is shown that includes a single cam track 92 on the outer surface 94. The single cam track 92 includes a detent 96 having a substantially arcuate shape. In addition, a projection 98 is located on the opposite side of the cam track 92. In use, when rotating the adjuster 31, the cam follower 39 is guided into the detent 96 by projection 98.

Figure 5:
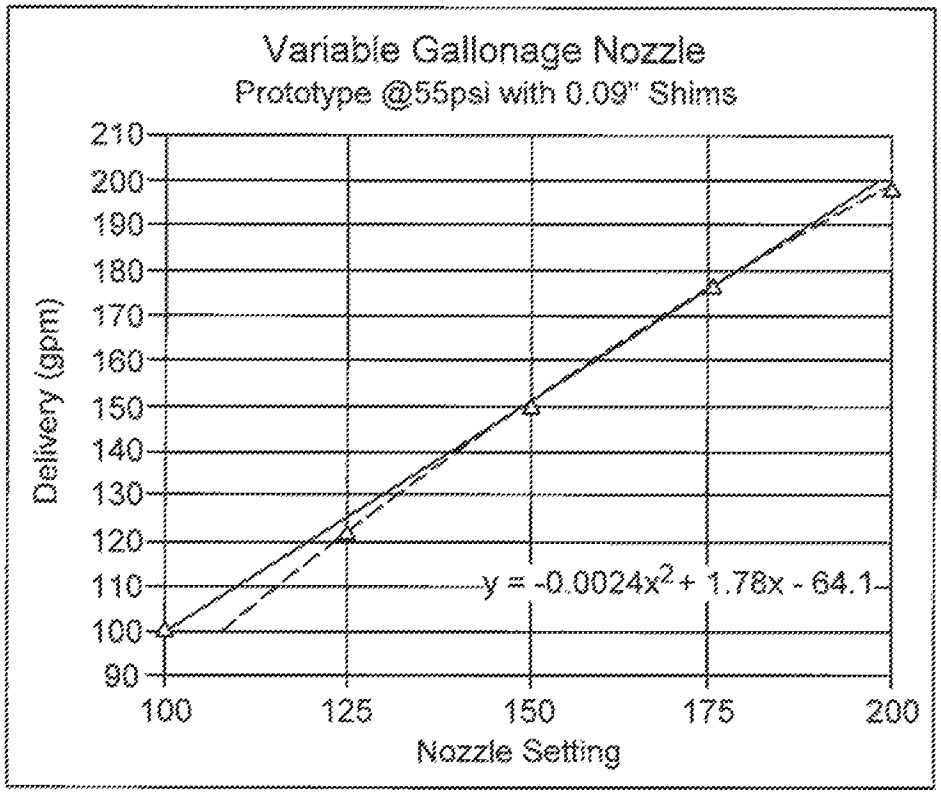
FIG. 5 shows example flow test results for a nozzle in accordance with an embodiment of the present invention.

Referring now to FIG. 5, a graph of typical flow values for an embodiment of a nozzle 15 of the present invention is illustrated. For the nozzle test results shown in FIG. 5, the subject nozzle had detent positions corresponding to those shown in FIGS. 4A-4D. With cam follower 39 positioned at detent 60, the flow rate was 100 gallons per minute; with cam follower 39 positioned at detent 59, the flow rate was 120 gallons per minute; with cam follower 39 positioned at detent 58, the flow rate was 150 gallons per minute; with cam follower 39 positioned at detent 57, the flow rate was 175 gallons per minute; and with cam follower 39 positioned at detent 56, the flow rate was 197 gallons per minute.

In accordance with at least one embodiment of the present invention, at least one type of indicia is provided to assist the operator in assessing the flow rate of the nozzle 15. For example, in at least one embodiment of the present invention, flow rate markings are placed at selected radial positions around downstream housing portion 33 to indicate the flow associated for each of the five cam detent positions. Alternatively, a variable color indicator may be used, for example, varying between red and blue, or a variable gray shade indicator may be used, for example, varying between white and black. In yet another alternative, combinations of the indicia noted above may be used.

As described above, the location of each detent position is defined by an angle and an offset distance, as shown in FIGS. 4A-4D. Detent position 56 is the reference detent position. Accordingly, detent position 57 is offset from detent position 56 by angle A1 and offset distance D1; detent position 58 is offset from detent position 56 by angle A2 and offset distance D2; detent position 59 is offset from detent position 56 by angle A3 and offset distance D3; and detent position 60 is offset from detent position 56 by angle A4 and offset distance D4. The values of coordinates A1-D1, A2-D2, A3-D3, and A4-D4 are varied to achieve the desired flow rate characteristics associated with each of the defined detent positions.

Figure 6C:
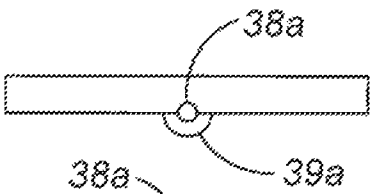
FIGS. 6A-6C are views of an outer nut and cam follower ring for a nozzle in accordance with an embodiment of the present invention.
Figure 6B:
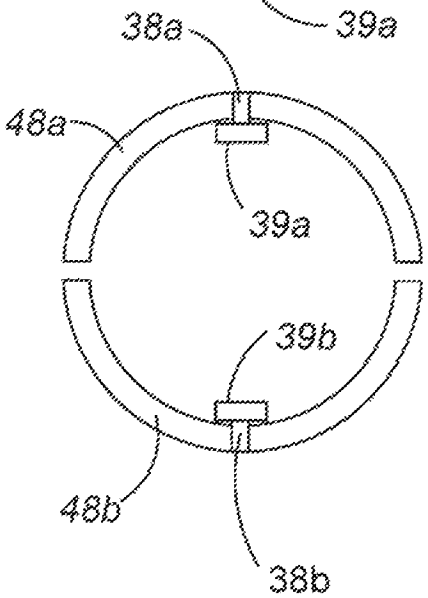
Figure 6A:
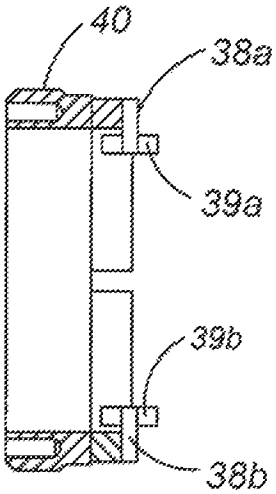

Referring now to FIGS. 6A-6C, and in accordance with embodiments of the present invention, a pair of split rings 48*a* and 48*b* are shown that serve as the carriers of cam follower pins 38*a* and 38*b*. More particularly, the cam followers 39*a* and 39*b* rotate on pins 38*a* and 38*b*. Pins 38*a* and 38*b* are retained by openings in the split rings 48*a* and 48*b*. In one or more embodiments of the invention, approximately ⅔ of the pins are recessed into rings 48*a* and 48*b*, the remaining ⅓ of the pins are exposed and aligned with grooves in downstream housing portion 33.

The nozzle 11 of the present invention allows for an infinite number of GPM settings between an upper and lower GPM range it is ideal for optimizing performance (stream reach, nozzle reaction and GPM) by the nozzle operator, thus reducing the importance of communication between the nozzle operator and the pump operator. This communication may be difficult to manage at an intense fire scene with rapidly changing dynamics. This variable GPM feature makes the nozzle 11 a preferable choice for foam applications especially compressed air foam (CAF) since an additional variable (air and foaming agent must now also be managed). Embodiments of the present invention are designed to have an upper GPM limit consistent with the volume of water that can flow inside a hose at a set pressure and diameter capable of mating with the nozzle and lower flow limit. The lower limit is set at a GPM level that is typically the lowest firefighters use for hand lines.

Figure 7C:
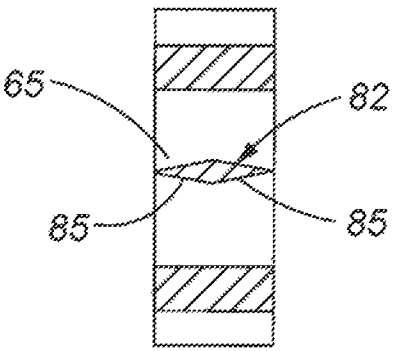
FIGS. 7A-7C are views of a spider that attaches the tapered pin to the housing for a nozzle in accordance with an embodiment of the present invention.
Figure 7B:
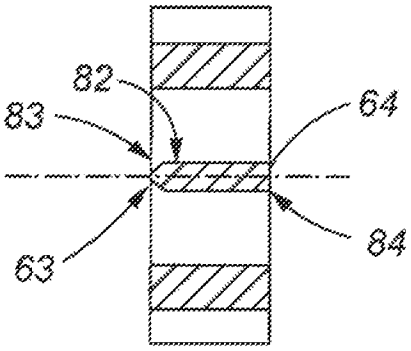
Figure 7A:
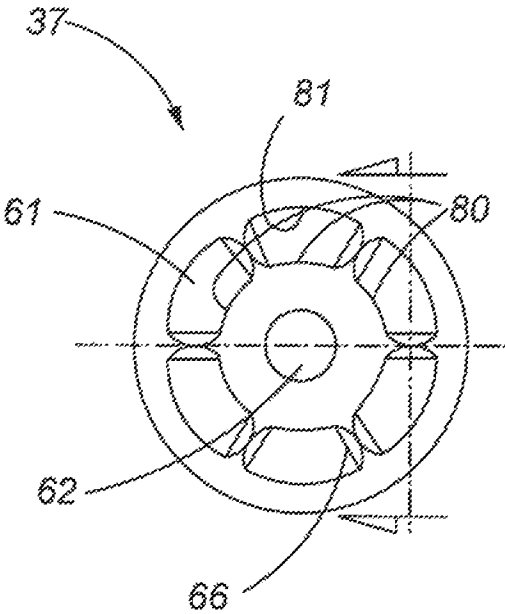

Referring now to FIGS. 7A-7C, and in accordance with one or more embodiments of the present invention, a number of detail views of the spider 37 are shown. For the embodiment shown in FIGS. 7A-7C, a central hole 62 in spider 37 is used to align tapered entrance pin 34 and tapered exit pin 43. In at least one embodiment, a threaded connecting member 44 is used to retain tapered pins 34 and 43. The spider 37 has a web 66, which includes a plurality of passageways 61 for fluid flow. Each passageway 61 is defined by a fin 82 on each side, as well as by an inner and an outer radius of the spider 37. The inner radius 80 matching the outer major diameters of tapered entrance pin 34 and tapered exit pin 43, the outer radius 81 matching the inner bore of nut 35.

The function of the spider 37 is two fold. Firstly, the spider 37 provides a mounting for tapered pins 34 and 43. Secondly, the spider 37 functions as a flow straightener. As fluid flows through each passageway 61, a laminar flow is thereby created, which allows the fluid to be shaped as it exits from the nozzle. The spider 37 creates a flow of fluid characterized by a constant velocity throughout the different portions of the fluid flow. More particularly, the velocity of the fluid is the same at the core of the stream as it is at the periphery of the stream. This creates a flow of fluid that exits the nozzle in a smooth column of fluid. As the fluid at the center of the stream is traveling at the same rate of speed as fluid at the periphery of the stream, the column of water does not tend to fragment as it flies through the air. In this way, the column of fluid retains its shape for a longer distance. Without the flow straightener or spider 37 in the fluid path, the velocity of the fluid at the center of the stream would tend to be greater than the velocity of the fluid at the periphery of the stream. This is due to the interaction between the water and the inner-diameter of the nozzle, known as the wall affect. By putting the spider 37 in the fluid path, a wall affect is thereby created throughout the stream. More particularly, the inner portions of the fluid stream are slowed to a rate that is consistent with the speed at which the periphery of the stream travels. Accordingly, a smooth laminar flow is thereby created. As the spider operates to slow the rate at which the water travels, it is preferable to increase the pressure of the fluid to thereby compensate for the slowing affect caused by the spider. Here a consistent and desirable fluid flow is produced, whose reach is not adversely affected by the slowing effect of the spider.

The spider 37 of the present invention differs from prior art flow straighteners in its position with respect to other nozzle components. Typically, prior art flow straighteners include a mesh screen disposed between the hose and the nozzle. The mesh screen includes a number of square shaped holes which provide a passageway for fluid to flow between the hose and the nozzle. The spider 37 of the present invention, in contrast, is an integral part of the nozzle design. More particularly, it is disposed concentrically with the tapered pins 34 and 43. As stated above, the spider 37 additionally provides a mounting for the pins 34 and 43.

The fluid passageways 61 may be of any suitable shape. For example, in accordance with one embodiment of the present invention, the fluid passageway may include about six to about eight openings, each comprising a portion of a triangle, with an aggregate open area for all openings of approximately 1.0 square inch. In a preferred embodiment, it has been found that the configuration and aggregate open area of the fluid passageways 61 provide the above described flow shaping properties. Additionally, the dimensions for the each fluid passageway 61 provide the ability to "flush the nozzle". More particularly, the spider 37 is capable of passing certain marble sized articles, such as a quarter inch ball bearing. Passing an object of this size simulates the kind of debris that a fire company would pick up if they were drafting water from a lake, which is often done by rural fire companies.

In at least one embodiment of the invention, the spider 37 preferably comprises six passageways 61 and six fins 82. Each fin 82 is streamlined to present minimum resistance to fluid flow and to minimize the generation of turbulence. In at least one embodiment of the invention, the fins 82 preferably have a radius 63 on the leading edge 83 and a blunt profile 64 on the trailing edge 84. In yet another embodiment, the fins 82 have a streamlined profile 65 with tapered portions 85 to further reduce fluid turbulence. The size and number of fluid passageways 61 through spider 37 may be adjusted to optimally coordinate with the viscosity, velocity and frangibility of the fluid.

Figure 8A:
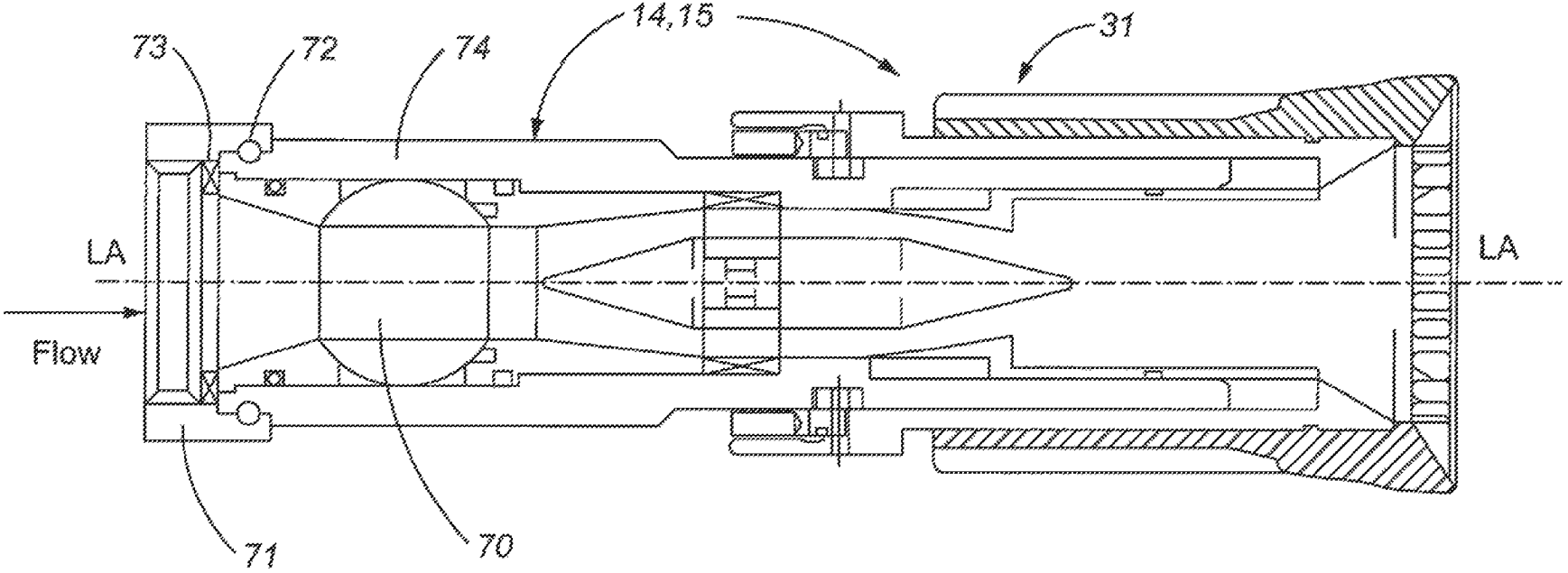
FIG. 8A is a cross-sectional view of a combined nozzle and shutoff valve for a nozzle in accordance with an embodiment of the present invention.
Figure 8B:
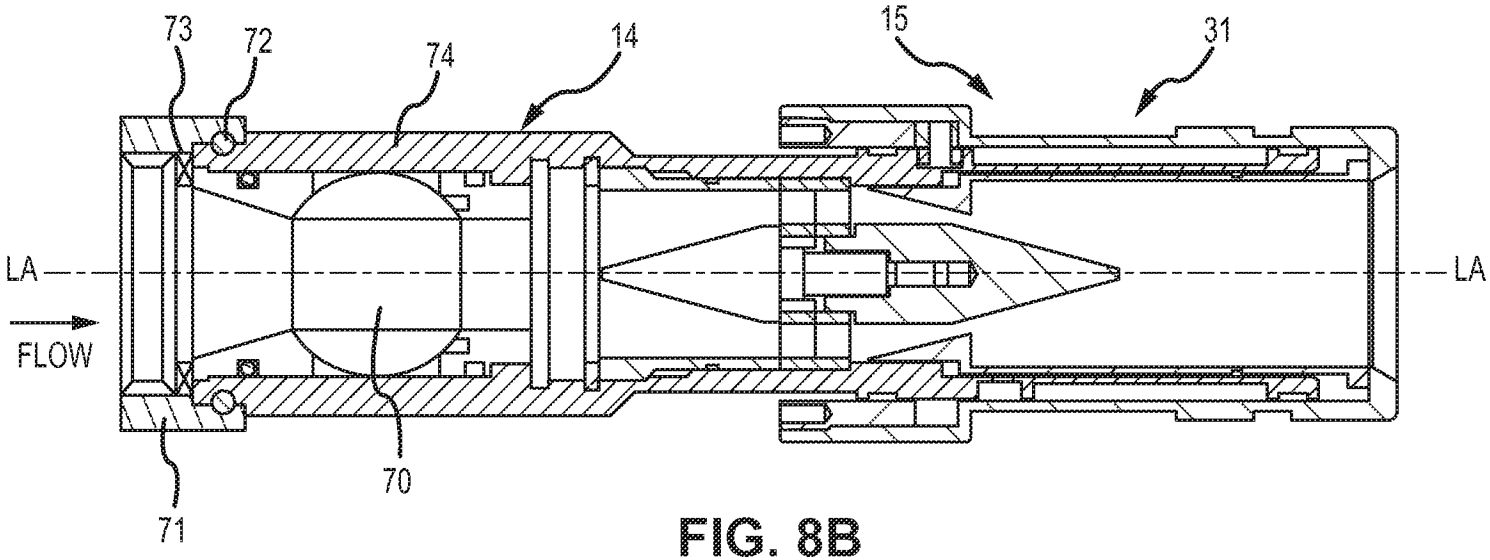
FIG. 8B is a cross-sectional view of a combined nozzle and shutoff valve for a nozzle in accordance with an embodiment of the present invention.

Referring now to FIGS. 8A and 8B, and in accordance with at least one embodiment of the invention, nozzle 15 is combined with a shutoff valve 14. A hose 13 may be attached to the combination shutoff valve and nozzle by means of the swivel nut 71 that is attached to body 74 by a plurality of spheres 72. Gasket 73 provides a seal between the end of the hose fitting and body 74. In at least one embodiment of the invention the nut 71 is decoupled from longitudinal body 30 and is free to rotate independently of body 74. In this manner the housing may be aligned so that the pivot axis of shutoff ball 70 and the flow rate marking on downstream housing portion 33 may be aligned for the convenience of the nozzle user. Alternatively, and in yet another embodiment of the invention, nut 71, spheres 72 and gasket 73 are attached to the end of longitudinal body 30, providing for convenient alignment of flow rate marking on downstream housing portion 33.

For at least one embodiment of the invention, in use, the nozzle 15 is first connected to a hose 13 or control valve 14. At some subsequent time, an operator of the nozzle 15 can selectively adjust the amount of flow projected by the nozzle 15 by turning adjuster 31. More particularly, assuming that the nozzle 15 is in a first low-flow setting (corresponding to FIG. 2), the operator can increase the stream or deluge flow projected by the nozzle 15 by simply rotating the adjuster 31. Here, the operator causes the adjuster 31 to move in a longitudinal direction, such as by rotating the end bell 32 in a counter-clockwise direction (although a clockwise direction is equally possible by construction of the cam tracks in a suitable orientation), to cause the interconnected downstream housing portion 33 to rotate about the longitudinal body 30, as guided by cam followers 39*a* and 39*b* moving along cam tracks 50 and 51. As the downstream housing portion 33 moves in a longitudinally distal direction, the slider 41 moves in the same direction. That is, the slider 41 moves in the direction of flow as the internal lip 46 of the downstream housing portion 33 moves in the downstream direction. The flow rate from the nozzle increases because the internal taper 22 of the slider 41 moves longitudinally relative to the exit taper pin 43, thereby enlarging the orifice restriction 42 within the flow chamber 17 of the longitudinal body 30. The flow rate can be increased to its maximum rate by setting the adjuster to the maximum flow setting (corresponding to FIGS. 3A and 3B) through full rotation of the downstream housing portion 33 relative to the non-rotating longitudinal body 30. At the maximum flow setting, the cam followers have traversed the entire length of cam tracks, and the slider 41 has moved to its maximum longitudinally distal position. If detents are provided along the cam tracks, the flow rate can be held constant until such time as the user induces further rotation to the adjuster 31 to move the cam followers 39*a* and 39*b* from the given detent to traverse further along the cam track 50, 51. In at least one embodiment of the invention, the flow rate increases by about a factor of two from its low-flow setting to its high-flow setting.

The following references are incorporated herein by reference in their entirety for at least the purposes of written description and enablement: U.S. Pat. Nos. 6,089,474 and 7,097,120.

For the nozzle 15 shown in at least FIGS. 2, 3 and 8, the nozzle 15 emits only a stream type of flow; that is, no fog spray is generated by the nozzle, no matter what the flow rate setting for the nozzle. However, in other embodiments not shown, a mechanism for aspirating the flow may be included at the distal end of the nozzle for generating a fog spray in conjunction with the stream flow. By way of example and not limitation, an interceptor (not shown) at the outer radius of the stream flow may be provide to generate a fog spray, and such interceptor may be selectively adjustable to provide between zero or no fog spray and a significant amount of fog spray. Such embodiments are considered within the scope of the present invention.

In a separate embodiment (not shown) of the invention, a valve device comprising the longitudinal body 30 and at least some of its associated features, potentially including the adjuster 31 and the slider 41, is modified for placement in-line within a fluid conduit, such as piping, so that the device serves as a throttling valve and/or fluid restriction/flow control apparatus. In at least one embodiment of the present invention, a pipe, hose, or other fluid conveyance device may be interconnected to the exit end 19 of the flow chamber 17. Such an embodiment illustrates the variety of uses of the present invention, and such modified versions of the device are considered within the scope of the present invention. Such a valve, restriction, or flow control device has application for use in facilities that have piping, hoses, and/or fluid conduits that convey any type of fluid, including, but not limited to water, mixtures, beverages, chemicals, compounds, petrol, etc., and such applications and any methods of use associated therewith are considered to be within the scope of the present invention.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights that include alternative embodiments to the extent permitted, including alternate, interchangeable and/or equivalent structures, functions, ranges or steps to those claimed.

What is claimed is:

1. A nozzle for dispensing a flow of a fluid, comprising:

a longitudinal body comprising a chamber wall and a flow chamber within the chamber wall, the flow chamber having a fluid entrance end, a fluid exit end, and a flow deflector, the flow deflector comprising a tapered body, the tapered body having a first end with a taper that converges at the fluid entrance end and a second end with a taper that converges at the fluid exit end, the second end having an angle that allows the fluid flowing through the flow chamber to form a smooth laminar flow of fluid at the fluid exit end, the tapered body longitudinally supported in the flow chamber by a support comprising a web, the web comprising a plurality of static fins, a central hole adapted to align the tapered body within the flow chamber, and a plurality of passageways permitting fluid to flow therethrough; said web supporting the tapered body between the first end and the second end along a cylindrical flat portion of the tapered body, a slider slideably moveable along a longitudinal axis of the longitudinal body;

an adjuster associated with the longitudinal body, the adjuster comprising a rotatable housing portion, the housing portion adapted to move laterally with respect to the longitudinal body to enable an operator of the nozzle to selectively adjust an amount of flow projected by the nozzle by turning the adjuster; and wherein said slider being a tubular valve having a tapering orifice, wherein the slider is disposed in as interior of the rotatable housing portion, wherein rotation of the housing portion is configured to move the slider along the longitudinal axis to selectively adjust an amount of flow projected by the nozzle.

2. The nozzle of claim 1, wherein the tapered body has a varying cross-section along a longitudinal axis.

3. The nozzle of claim 1, wherein the fins are uniformly spaced about the tapered body.

4. The nozzle of claim 1, wherein rotation of the rotatable housing portion moves the slider relative to the tapered body.

5. The nozzle of claim 1, wherein the plurality of passageways comprises at least six passageways, each passageway comprising a portion of a triangle.

6. The nozzle of claim 1, wherein said web supports a mid-portion of the tapered body between said first end with a taper that converges at the fluid entrance end and said second end with a taper that converges at the fluid exit end.

7. The nozzle of claim 1, wherein an angle of the taper of the first end is greater than the angle of the taper of the second end.

8. The nozzle of claim 7, wherein the angle of the second end is selected from one of the groups of between about 1° and about 45°, between about 5° and about 35°, and between about 10° and about 20°.

9. The nozzle of claim 7, wherein the angle of the first end is between about 10° and about 20°.

10. The nozzle of claim 1, wherein the first and second ends are formed of one integral piece.

11. The nozzle of claim 1, wherein the housing portion is interconnected to a cam follower ring that comprises cam followers that move within cam tracks disposed on an exterior surface of the longitudinal body, the cam follower ring adapted to rotate and move the cam followers within the cam tracks such that the cam follower ring and the housing portion are urged in a lateral movement along the longitudinal body.

12. The nozzle of claim 1, wherein the slider is disposed in an interior of the longitudinal body that is slideably moveable along a longitudinal axis of the longitudinal body, wherein the housing portion and the slider are adapted to move in the same direction.

13. The nozzle of claim 12, wherein the amount of flow projected by the nozzle increases when the slider is moved relative to the tapered body.

14. A method of adjusting a flow rate of a flow of a fluid from a nozzle, comprising:

providing a nozzle comprising a longitudinal body comprising a chamber wall and a flow chamber within the chamber wall, the flow chamber having a fluid entrance end, a fluid exit end, and a flow deflector, the flow deflector comprising a tapered body, the tapered body having a first end with a taper that converges at the fluid entrance end and a second end with a taper that converges at the fluid exit end, the second end having an angle that allows the fluid flowing through the flow chamber to form a smooth laminar flow of fluid at the fluid exit end, the tapered body longitudinally supported in the flow chamber by a support comprising a web, the web comprising a plurality of static fins, a central hole adapted to align the tapered body within the flow chamber, and a plurality of passageways permitting fluid to flow therethrough; said web supporting the tapered body between the first end and the second end along a cylindrical flat portion of the tapered body, a slider slideably movable along a longitudinal axis of the longitudinal body; an adjuster associated with the longitudinal body, the adjuster comprising a rotatable housing portion, the housing portion adapted to move laterally with respect to the longitudinal body to enable an operator of the nozzle to selectively adjust an amount of flow projected by the nozzle by turning the adjuster; wherein said slider being a tubular valve having a tapering orifice, wherein the slider is disposed in an interior of the rotatable housing portion, wherein rotation of the housing portion is configured to move the slider along the longitudinal axis to selectively adjust an amount of flow projected by the nozzle;

and rotating the adjuster to selectively adjust an amount of flow projected by the nozzle.

15. The method of claim 14, wherein an angle of the taper of the first end is complementary to the angle of the taper of the second end.

16. The method of claim 14, wherein the plurality of passageways comprises at least six passageways, each passageway comprising a portion of a triangle.

17. The method of claim 14, wherein the angle of the second end is selected from one of the groups of between about 1° and about 45°, between about 5° and about 35°, and between about 10° and about 20°.

18. The method of claim 14, wherein the housing portion is interconnected to a cam follower ring that comprises cam followers that move within cam tracks disposed on an exterior surface of the longitudinal body, the cam follower ring adapted to rotate and move the cam followers within the cam tracks such that the cam follower ring and the housing portion are urged in a lateral movement along the longitudinal body.

19. The method of claim 14, wherein the slider is disposed in the interior of the longitudinal body and is slideably moveable along a longitudinal axis of the longitudinal body, wherein the housing portion and the slider are adapted to move in the same direction.

20. The method of claim 14, wherein the amount of flow projected by the nozzle increases when the slider is moved relative to the tapered body.

21. The nozzle of claim 1, wherein an angle of the taper of the first end is complementary to the angle of the taper of the second end.

22. The nozzle of claim 1, wherein the angle of the second end is from between about 5° and about 35°.

23. A nozzle for dispensing a flow of a fluid, comprising:

a longitudinal body comprising a chamber wall and a flow chamber within the chamber wall, the flow chamber having a fluid entrance end, a fluid exit end, and a flow deflector, the flow deflector comprising a tapered body, the tapered body having a first end with a taper that converges at the fluid entrance end and a second end with a taper that converges at the fluid exit end, the second end having an angle that allows the fluid flowing through the flow chamber to form a smooth laminar flow of fluid at the fluid exit end, the tapered body longitudinally supported in the flow chamber by a support comprising a web, the web comprising a plurality of static fins, a central hole adapted to align the tapered body within the flow chamber, and a plurality of passageways permitting fluid to flow therethrough; said web supporting the tapered body between the first end and the second end along a cylindrical flat portion of the tapered body, a slider slideably moveable along a longitudinal axis of the longitudinal body;

an adjuster associated with the longitudinal body, the adjuster comprising a rotatable housing portion, the housing portion adapted to move laterally with respect to the longitudinal body to enable an operator of the nozzle to selectively adjust an amount of flow projected by the nozzle by turning the adjuster;

wherein said slider being a tubular valve having a tapering orifice, wherein the slider is disposed in an interior of the rotatable housing portion, wherein rotation of the housing portion is configured to move the slider along the longitudinal axis to selectively adjust an amount of flow projected by the nozzle;

wherein the housing portion is interconnected to a cam follower ring that comprises cam followers that move within cam tracks disposed on an exterior surface of the longitudinal body, the cam follower ring adapted to rotate and move the cam followers within the cam tracks such that the cam follower ring and the housing portion are urged in a lateral movement along the longitudinal body; and wherein the fins are uniformly spaced about the tapered body.

24. The nozzle of claim 23, wherein the angle of the second end is between about 1° and about 45°.

25. The nozzle of claim 23, wherein the angle of the first end is between about 5° and about 35°.

26. The nozzle of claim 23, wherein the slider is disposed in an interior of the longitudinal body that is slideably moveable along a longitudinal axis of the longitudinal body, wherein the housing portion and the slider are adapted to move in the same direction.

27. A nozzle for dispensing a flow of a fluid, comprising:

a longitudinal body comprising a chamber wall and a flow chamber within the chamber wall, the flow chamber having a fluid entrance end, a fluid exit end, and a flow deflector, the flow deflector comprising a tapered body, the tapered body having a first end with a taper that converges at the fluid entrance end and a second end with a taper that converges at the fluid exit end, the second end having an angle that allows the fluid flowing through the flow chamber to form a smooth laminar flow of fluid at the fluid exit end, the tapered body longitudinally supported in the flow chamber by a support comprising a web, the web comprising a plurality of static fins, a central hole adapted to align the tapered body within the flow chamber, and a plurality of passageways permitting fluid to flow therethrough; said web supporting the tapered body between the first end and the second end along a cylindrical flat portion of the tapered body, a slider slideably moveable along a longitudinal axis of the longitudinal body;

an adjuster associated with the longitudinal body, the adjuster comprising a rotatable housing portion, the housing portion adapted to move laterally with respect to the longitudinal body to enable an operator of the nozzle to selectively adjust an amount of flow projected by the nozzle by turning the adjuster;

wherein said slider being a tubular valve having a tapering orifice, wherein the slider is disposed in an interior of the rotatable housing portion, wherein rotation of the housing portion is configured to move the slider along the longitudinal axis to selectively adjust an amount of flow projected by the nozzle;

wherein the angle of the second end is selected from one of the groups of between about 1° and about 45°, between about 5° and about 35°, and between about 10° and about 20°; and wherein an angle of the taper of the first end is greater than the angle of the taper of the second end.

* * * * *